US005558511A

United States Patent [19]

Hedelin

[11] Patent Number: 5,558,511

[45] Date of Patent: Sep. 24, 1996

[54] SLIDING VANE MACHINE HAVING VANE GUIDES AND INLET OPENING REGULATION

[75] Inventor: Lars G. Hedelin, Djursholm, Sweden

[73] Assignee: Fanja Ltd., Jersey, United Kingdom

[21] Appl. No.: 411,758

[22] PCT Filed: Oct. 14, 1993

[86] PCT No.: PCT/SE93/00841

§ 371 Date: Mar. 30, 1995

§ 102(e) Date: Mar. 30, 1995

[87] PCT Pub. No.: WO94/09260

PCT Pub. Date: Apr. 28, 1994

[30] Foreign Application Priority Data

Oct. 15, 1992 [SE] Sweden ..... 9203034

[51] Int. Cl.[6] ..... F01C 1/344; F01C 21/12

[52] U.S. Cl. ..... 418/150; 418/159; 418/264

[58] Field of Search ..... 418/150, 159, 418/261, 264, 265

[56] References Cited

U.S. PATENT DOCUMENTS

| | | | |
|---|---|---|---|
| 2,469,714 | 5/1949 | Cooper | 417/440 |
| 3,334,546 | 8/1967 | Voulle-Apiala | 418/159 |
| 3,797,975 | 3/1974 | Keller | 418/159 |
| 4,272,227 | 6/1981 | Woodruff | 418/185 |
| 4,410,305 | 10/1983 | Shank et al. | 418/150 |
| 5,160,252 | 11/1992 | Edwards | 418/150 |
| 5,181,843 | 1/1993 | Hekman et al. | 418/150 |

FOREIGN PATENT DOCUMENTS

| | | | |
|---|---|---|---|
| 3109835 | 9/1982 | Germany . | |
| 3801232 | 12/1988 | Germany . | |
| 81457 | 5/1956 | Netherlands | 418/159 |

*Primary Examiner*—John J. Vrablik
*Attorney, Agent, or Firm*—Young & Thompson

[57] ABSTRACT

A sliding vane machine with a cylindrical rotor (11) eccentrically placed in a housing, the rotor being rotatably mounted in the housing with its periphery in contact with the interior of the housing at one point and being provided with a number of vanes (13). The vanes are guided in grooves (12) in the rotor (11) for essentially radial movement and delimit, together with the rotor (11) and the housing (1), chambers (14) for transporting a medium from an inlet opening (15) to a delivery opening (16). The movement of each of the vanes (13) is guided by at least one guide (17, 18), which runs along a guide race (19) in the housing. The guide race (19) and/or the interior of the housing (1) has such a shape, that the radially distal end of each vane (13) follows the contour of the interior of the housing (1).

8 Claims, 3 Drawing Sheets

SLIDING VANE MACHINE HAVING VANE GUIDES AND INLET OPENING REGULATION

The invention relates to a sliding vane machine with a cylindrical rotor, eccentrically placed in a housing, said rotor being rotatably mounted in the housing by means of a drive shaft, the periphery of the rotor touching the interior of the housing at one point, as seen in a plane perpendicular to the rotational axis of the rotor, which is provided with a number of vanes, which are guided in slots in the rotor for essentially radial movement relative thereto, said vanes delimiting, together with the rotor and the housing, chambers for transferring a medium from an inlet opening in the housing to a delivery opening in the housing.

Sliding vane machines of this type are well known and are used, e.g. as pumps and compressors for gaseous media of various types. One problem with these known sliding vane machines is to achieve an effective seal between the radially distal ends of the vanes and the interior of the surrounding housing. It is common to allow the distal ends of the vanes to abut against the housing, either directly or via some form of sealing strip. This gives rise, however, to appreciable friction and wear and dimensions and rpm must be kept down, since the centrifugal force on the vanes would otherwise increase the friction and wear dramatically.

These problems have limited previously known sliding vane machines to being relatively small and operating at relatively low rpm. The capacity of these known sliding vane machines has thus been relatively low.

The purpose of the present invention is to provide a sliding vane machine, in which the above mentioned problems have been solved and which can work at a higher rpm and be made with larger dimensions without friction and wear giving rise to problems.

This is achieved according to the invention by virtue of the fact that the movement of each of the vanes relative to the rotor is guided by means of at least one guide means, which runs along a guide race in the housing, said guide race and/or the interior of the housing, as seen in a plane perpendicular to the rotational axis of the rotor, having such shape that the radially distal end of each vane follows the contour of the interior of the housing.

With this construction the path of movement of the radially distal end of each of the vanes is adapted so that a very small gap is maintained between the vane and the housing without any direct contact. This avoids the problem with friction and wear at the same time as correct dimensioning can reduce the gap between the vane and the housing so that loss due to leakage between the vane and the housing is kept at a very low level.

Figure 1:
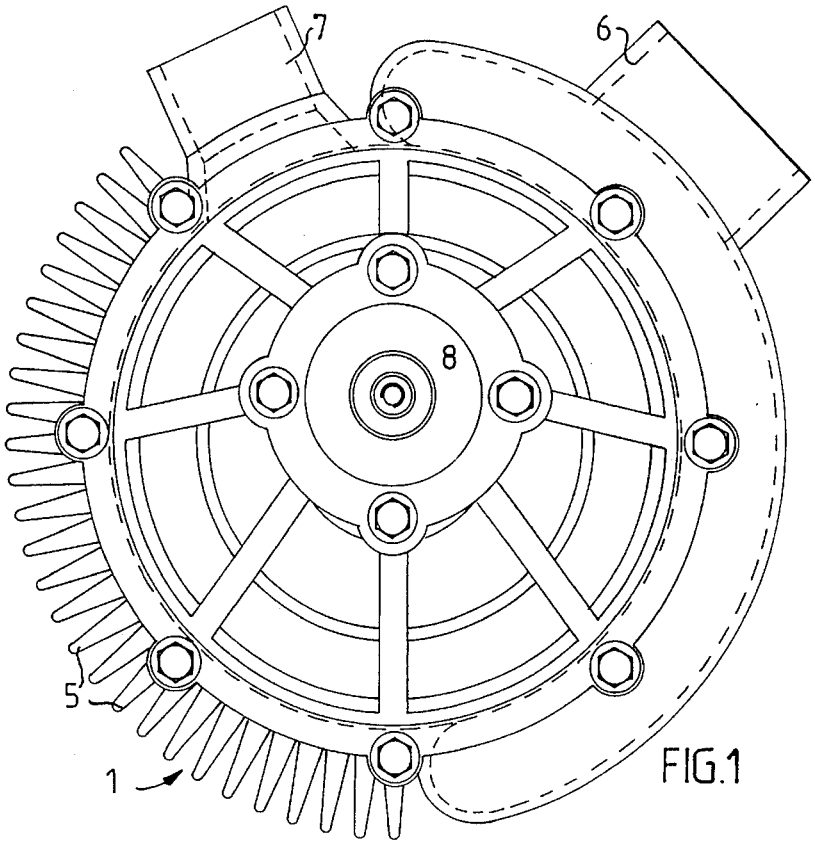
Figure 2:
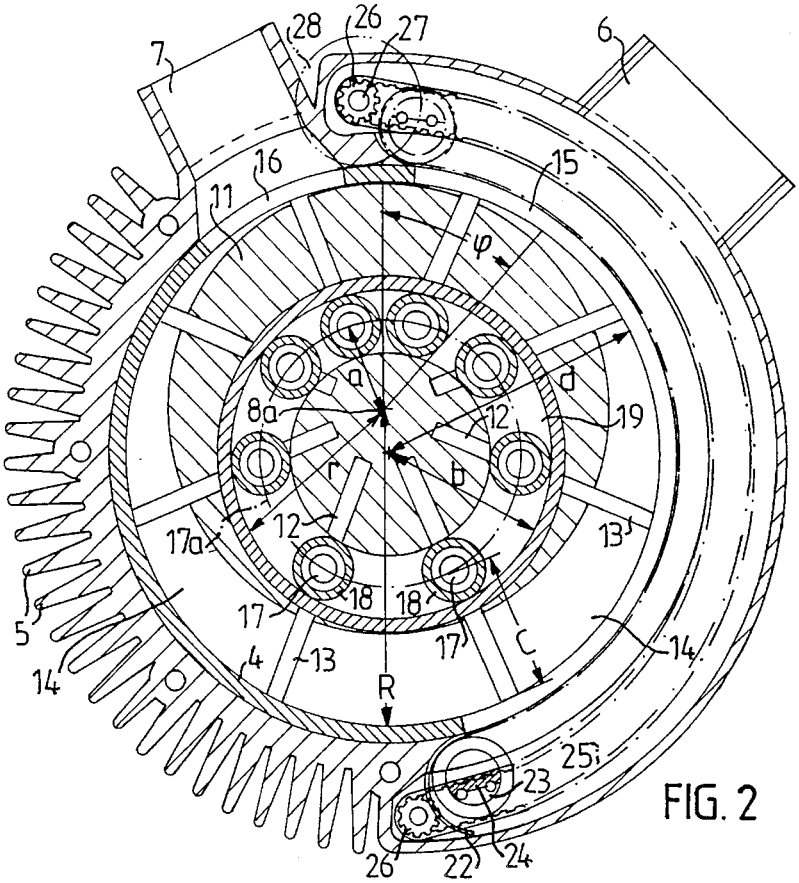
Figure 4:
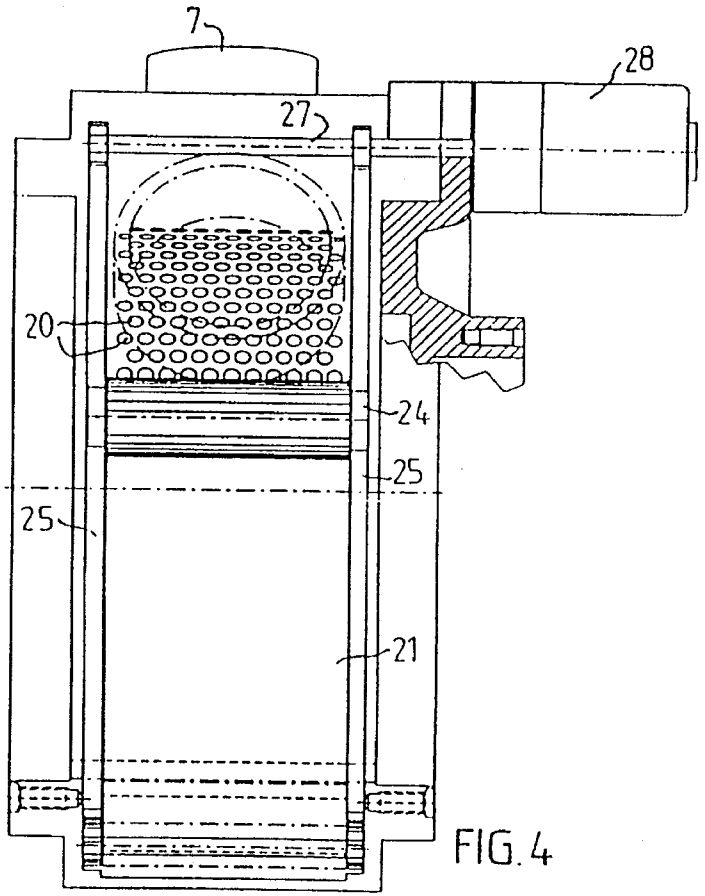
Figure 3:
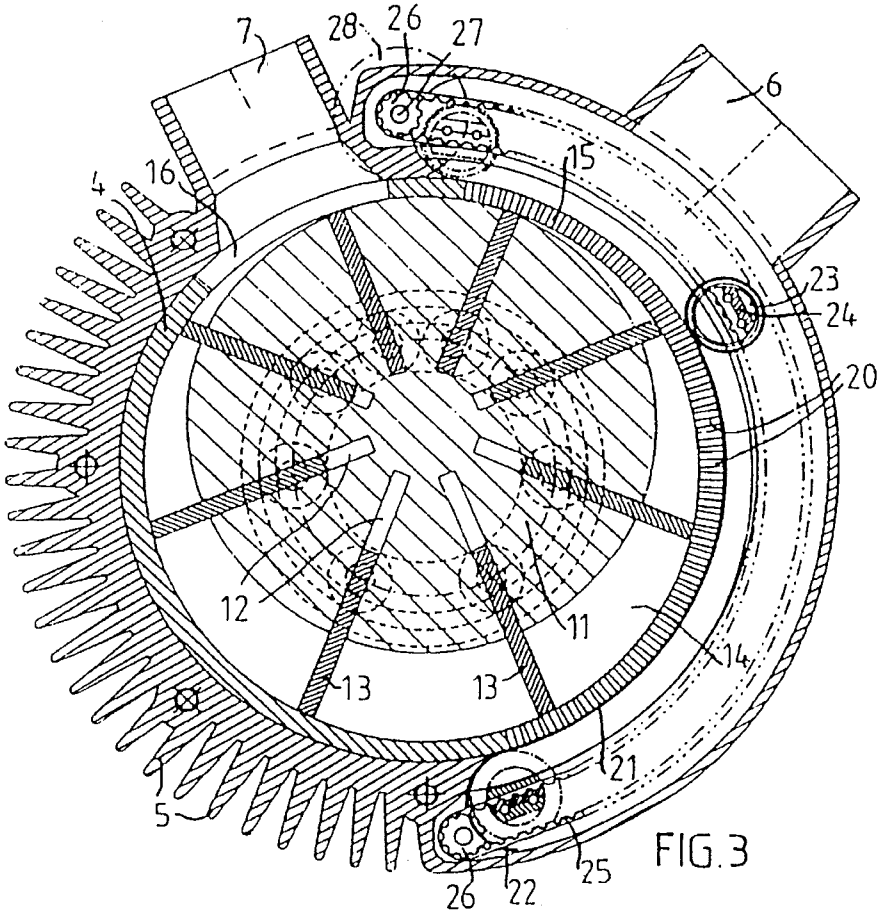
Figure 5:
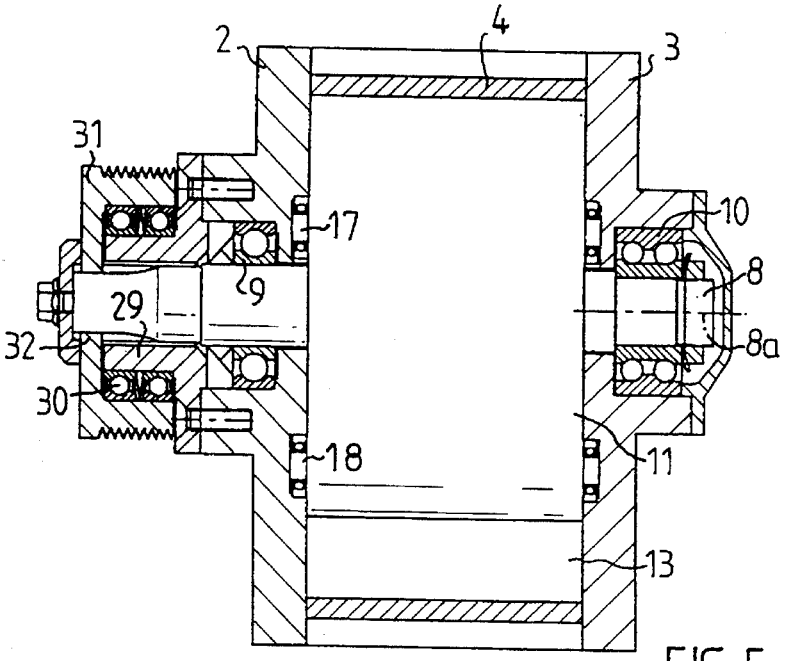
Figure 6:
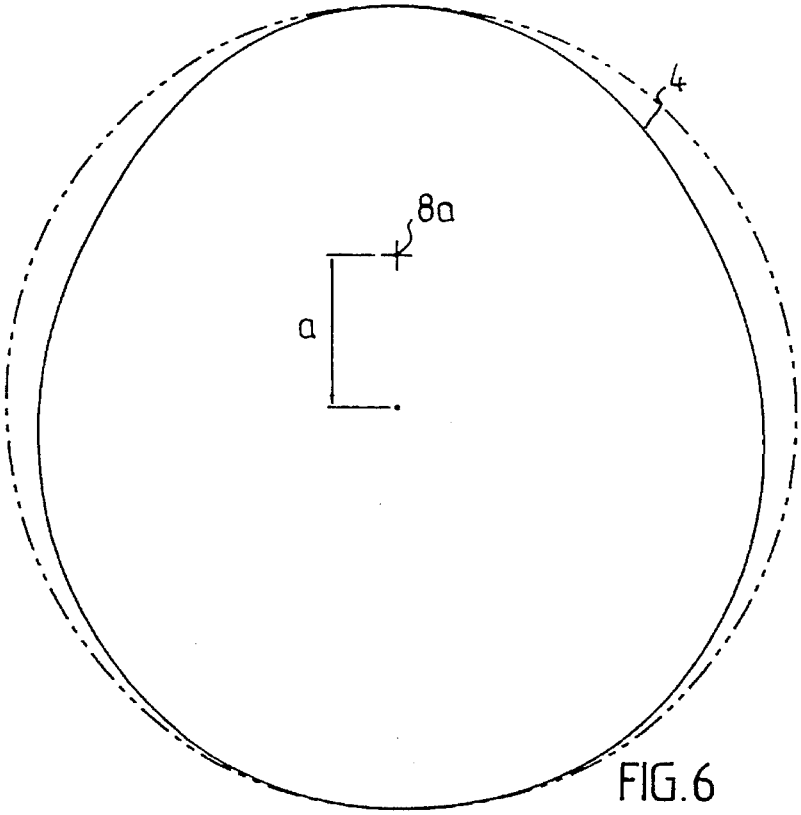

The invention will be described in more detail below with reference to the accompanying drawings, of which FIG. 1 is an end view of a sliding vane machine according to one embodiment of the invention, FIG. 2 shows a section through a sliding vane machine, somewhat modified from the machine shown in FIG. 1, in the vicinity of the end plate of the sliding vane machine, FIG. 3 shows a section through the sliding vane machine according to FIG. 2, in the vicinity of the centre of the rotor, FIG. 4 is a partially cut-away side view of the sliding vane machine according to FIGS. 2 and 3, with certain parts removed, FIG. 5 shows an axial section through a somewhat schematically shown sliding vane machine according to the invention, FIG. 6 is a schematic figure, which in exaggerated form shows the contour of the interior of the housing of a sliding vane machine according to the invention inscribed in a circle.

FIG. 1 shows a sliding vane machine according to the invention as seen from one end. The sliding vane machine comprises a housing 1, which is constructed of two end pieces 2, 3 and an intermediate shell 4. The housing 1 is provided in the embodiment shown along a portion of its circumference with cooling flanges 5. Furthermore the housing 1 is provided with an entry duct 6 and a delivery duct 7 for connection to an intake conduct and a delivery conduct, respectively (not shown). FIG. 1 shows also a drive shaft 8 for driving the sliding vane machine.

FIGS. 2 and 5 show the interior construction of the sliding vane machine according to the invention. The drive shaft 8 is mounted in bearings 9, 10 in the end pieces 2, 3 of the housing 1. The drive shaft 8 supports a rotor 11, which is cylindrical and is arranged to rotate in the housing 1 with the drive shaft 8. As can be seen in the drawings, the drive shaft 8 is mounted with its rotational axis 8*a* eccentrically placed in the housing 1. The eccentricity is selected so that the rotor 11 almost touches at one place the interior of the shell 4. This place is located between the entry duct 6 and the delivery duct 7.

The rotor 11 is provided with a number of essentially radial grooves 12, which extend over the entire length of the rotor. In the grooves 12 radial vanes 13 are arranged extending essentially radially out of the rotor 11 to almost touch with their radially distal ends the interior of the shell 4 of the housing 1. The expression "essentially radially" means here that the grooves 12 and the vanes 13 can be arranged perfectly radially, i.e. where the center lines of the grooves and vanes are directed towards the rotational axis of the rotor, or somewhat displaced relative thereto, i.e. with the center lines directed so that they are tangent to a circle of a predetermined radius.

When the rotor 11 rotates in the housing 1, chambers 14 are delimited between two adjacent vanes 13 as well as the rotor 11 and the interior of the housing 1. These chambers 14 transport or move a medium, which flows in through the entry duct 6 and an inlet opening 15 in the shell 4 of the housing 1 from the inlet opening 15 to a delivery opening 16 in the shell 4, said delivery opening being connected to the delivery duct 7.

The vanes 13 are provided with laterally extending pins 17 in the vicinity of their radially proximal ends. The pins 17 support rolling bodies 18, which can be ball bearings or the like. The rolling bodies 18 are intended to roll in guide races 19 in the end pieces 2, 3 of the housing 1. The intention is to make it possible to guide the vanes 13 radially in such a manner that their distal ends are always kept very close to the interior of the housing shell 4. The guide races 19 are thus arranged so that their central axes coincide with the central axis of the shell 4.

In order for a sliding vane machine of the type described above to work satisfactorily, it is necessary to minimize leakage from one chamber 14 to the adjacent chamber. As was stated above, previously the radially distal ends of the vanes were allowed to slide against the interior of the housing, which means that the radial guiding of the vanes was provided with the aid of the housing. This has involved limitations regarding the performance of the sliding vane machine. According to the present invention, the pins 17 and the rolling bodies 18 provide in cooperation with the guide races 19 a forced guiding of the vanes 13 in the radial direction.

The forced guiding of the vanes 13 radially makes it possible to keep the radially distal ends of the vanes 13 in very close proximity to the interior of the shell 4 of the housing 1. With close tolerances of the cooperating components it will thus be possible to eliminate sealing means at the radially distal ends of the vanes 13. This eliminates friction and wear between the vanes 13 and the shell 4. Due to the fact that the vanes 13 are arranged radially relative to the rotor 11, the rotational axis 8a of which is spaced from the center of the shell 4, the distal ends of the vanes 13 will assume various angles relative to the shell 4 during the rotation of the rotor 11. In order for the distal ends of the vanes 13 to follow the interior of the shell 4 with great precision, it is therefore required that the interior of the shell 4 and/or the guide race 19 have a shape which deviates from the circular, as seen in a plane perpendicular to the rotational axis 8a of the rotor 11. There are three possibilities to achieve this, i.e. making the interior of the shell 4 with a special shape, making the guide race 19 with a special shape or making both of these components with a special shape.

When making the interior lateral surface of the shell 4 with a shape in accordance with the above, the surface should describe a curve in accordance with the formula $$R = C - a\cos\phi \pm \sqrt{a^2\cos^2\phi + b^2 - a^2},$$

where

R=the distance between the rotational axis 8*a* of the rotor 11 and the interior of the shell 4 of the housing 1, C=the length of the vane 13 from the center of the pin 17 to the radially distal end of the vane 13, a=the distance between the rotational axis 8*a* of the rotor 11 and the center of the guide race 19, b=the radius of the guide race 19, ϕ=the angle between the radius of the rotor 11 at its point of contact with the inside of the housing I and the line R.

The curve which is thus obtained in shown in exaggerated form in FIG. 6. The solid line shows the interior surface of the shell 4, while the the dash-dot line is the circle which would inscribe the interior surface of the shell of a conventional sliding vane machine.

If one choses instead to make the interior of the shell 4 circular cylindrical, the guide races 19 can be made to describe a curve according to the formula $$r = -C - a\cos\phi \pm \sqrt{a^2\cos^2\phi + d^2 - a^2},$$

where r=the distance between the rotational axis 8*a* of the rotor 11 and the guide race 19, C=the length of the vane 13 from the center of the pin 17 to the radially distal end of the vane 13, a=the distance between the rotational axis 8*a* of the rotor 11 and the center of the guide race 19, d=the distance between the center of the guide race 19 and the interior of the shell of the housing 1, ϕ=the angle between the radius of the rotor 11 at its point of contact with the interior of the housing 1 and the line r.

The curve which this formula generates is the curve followed by the centers of the pins 17, as is indicated by the dash-dot line 17*a* in FIG. 2.

As can be seen in the drawings, the inlet opening 15 covers, in the embodiment of the invention shown, a major portion of the circumference of the shell 4. The inlet opening 15 can, as is indicated in FIG. 2 and is shown in more detail in FIG. 3, be provided with a device for controlling the extent of the inlet opening in the circumferential direction of the shell 4. As can be seen in FIGS. 3 and 4, the inlet opening 15 is made as a portion of the shell 4, which is perforated by a large number of small holes 20. The device for controlling the size of the inlet opening 15 comprises a flexible membrane 21 with a width which covers the inlet opening 15, i.e. all of the openings 20. One end of the flexible membrane 21 is fixed at an anchoring point 22 in the housing 1. The other end of the flexible membrane 21 is fixed to a roller 23, which is rotatably mounted on a support means 24 and is suitably spring-biassed in the direction for winding up the flexible membrane 21. The support means 24 is in turn fixed at each side in a toothed belt 25. The toothed belts 25 run over cog-wheels 26 at the ends of the inlet opening 15. The cog-wheels 26 at the end of the inlet opening 15 remote from the anchoring point 22 are joined to a shaft 27 which is driven by a motor 28. With the aid of the motor 28 it is possible to move the roller 23 back and forth over the inlet opening 15, thus causing the flexible membrane 21 to cover the inlet opening 15 to a greater or lesser extent. In this manner it is possible to regulate the amount of medium which is introduced into each chamber 14 through the inlet opening 15.

FIG. 5 shows a design which makes it possible to improve the precision of the mounting of the rotor 11. This design involves relieving the drive shaft 8 of all forces produced by the driving. For this purpose, the end piece 2 is provided with a separate axially extending bearing surface 29, which is removably fixed to the end piece 2. A bearing 30 is mounted on the bearing surface 29 and supports a drive wheel 31. In the embodiment shown, the drive wheel 31 is a belt pulley, but it is also of course possible that the drive wheel 31 be a cog-wheel, a sprocket or the like. The drive wheel 31 is coupled to the drive shaft 8 with the aid of splines 32, which transmit torque but not radial or axial forces. The drive shaft 8 will therefore not be subjected to any deflection due to forces on the drive wheel 31.

The invention is not limited to the examples described above. Rather changes can be made within the scope of the following patent claims.

I claim:

1. In a sliding vane machine with a cylindrical rotor (11), eccentrically placed in a housing (1), said rotor being rotatably mounted in the housing by means of a drive shaft (8) the periphery of the rotor touching the interior of the housing at one point, as seen in a plane perpendicular to the rotational axis (8*a*) of the rotor (11), which is provided with a number of vanes (13), which are guided in grooves (12 ) in the rotor (11) for essentially radial movement relative thereto, said vanes (13) delimiting, together with the rotor (11) and the housing (1), chambers (14) for transferring a medium from an inlet opening (15) in the housing (1) to a delivery opening (16) in the housing, the movement of each of the vanes (13) relative to the rotor (11) being guided by means of at least one guide means (17, 18), which runs along a guide race (19) in the housing (1), said guide race (19) and/or the interior of the housing (1), as seen in a plane perpendicular to the rotational axis (8*a*) of the rotor (11), having such shape that the radially distal end of each vane (13) follows the contour Of the interior of the housing (1); the improvement wherein the interior of the housing (1), as seen in a plane perpendicular to the rotational axis (8*a*) of the rotor (11), follows a curve with the formula $$R = C - a\cos\phi \pm \sqrt{a^2\cos^2\phi + b^2 - a^2},$$

where

R=the distance between the rotational axis (8*a*) of the rotor (11) and the interior of the housing (1), C=the length of the vane (13) from the center of the guide means (17, 18) to the radially distal end of the vane (13), a=the distance between the rotational axis (8*a*) of the rotor (11) and the center of the guide race (19), b=the radius of the guide race (19), ϕ=the angle between the radius of the rotor (11) at its point of contact with the inside of the housing (1) and the line R.

2. Sliding vane machine according to claim 1, wherein the drive shaft (8) of the rotor (11) has a splined end which engages splines on a drive wheel (31), which is mounted for rotation on a separate bearing surface (29) supported by the housing (1).

3. Sliding vane machine according to claim 1, wherein each guide means consists of a pin (17) joined to the vane and extending axially from the vane (13) into a groove (19) in the end piece (2,3) of the housing (1), said groove being the guide race (19).

4. Sliding vane machine according to claim 3, wherein each pin (17) supports a roller body (18), which is intended to roll in the groove (19) in the housing (1).

5. Sliding vane machine according to claim 4, wherein the roller body (18) is a ball bearing.

6. In a sliding vane machine with a cylindrical rotor (11), eccentrically placed in a housing (1), said rotor being rotatably mounted in the housing by means of a drive shaft (8) the periphery of the rotor touching the interior of the housing at one point, as seen in a plane perpendicular to the rotational axis (8*a*) of the rotor (11), which is provided with a number of vanes (13), which are guided in grooves (12) in the rotor (11) for essentially radial movement relative thereto, said vanes (13) delimiting, together with the rotor (11) and the housing (1), chambers (14) for transferring a medium from an inlet opening (15) in the housing (1) to a delivery opening (16) in the housing, the movement of each of the vanes (13) relative to the rotor (11) being guided by means of at least one guide means (17, 18), which runs along a guide race (19) in the housing (1), said guide race (19) and/or the interior of the housing (1), as seen in a plane perpendicular to the rotational axis (8*a*) of the rotor (11), having such shape that the radially distal end of each vane (13) follows the contour of the interior of the housing (1);

the improvement wherein the guide race (19), seen in a plane perpendicular to the rotational axis (8*a*) of the rotor (11), follows a curve with the formula $$R = C - a\cos\phi \pm \sqrt{a^2\cos^2\phi + d^2 - a^2},$$

where r=the distance between the rotational axis (8*a*) of the rotor (11) and the guide race (19), C=the length of the vane (13) from the center of the guide means (17, 18) to the radially distal end of the vane (13), a=the distance between the rotational axis (8*a*) of the rotor (11) and the center of the guide race (19), d=the distance between the center of the guide race (19) and the interior of the housing (1), ϕ=the angle between the radius of the rotor (11) at its point of contact with the interior of the housing (1) and the line r.

7. In a sliding vane machine with a cylindrical rotor (11), eccentrically placed in a housing (1), said rotor being rotatably mounted in the housing by means of a drive shaft (8) the periphery of the rotor touching the interior of the housing at one point, as seen in a plane perpendicular to the rotational axis (8*a*) of the rotor (11), which is provided with a number of vanes (13), which are guided in grooves (12) in the rotor (11) for essentially radial movement relative thereto, said vanes (13) delimiting, together with the rotor (11) and the housing (1), chambers (14) for transferring a medium from an inlet opening (15) in the housing (1) to a delivery opening (16) in the housing, the movement of each of the vanes (13) relative to the rotor (11) being guided by means of at least one guide means (17, 18), which runs along a guide race (19) in the housing (1), said guide race (19) and/or the interior of the housing (1), as seen in a plane perpendicular to the rotational axis 8*a* of the rotor (11), having such shape that the radially distal end of each vane (13) follows the contour of the interior of the housing (1); the improvement wherein the inlet opening (15) in the housing (1) is provided with a device for regulating the length of the inlet opening, as seen in the rotational direction of the vanes (13), said device comprising a flexible membrane (21), the end of which is fixed to a roller (23), which can be moved along the inlet opening (15) during rotation for winding up or unwinding the membrane (21) onto or from the roller (23).

8. Sliding vane machine according to claim 7, wherein the roller (23) is fixed to a toothed belt (25) which is arranged to be driven by a motor (28) to move the roller (23) along the inlet opening (15) for winding up or unwinding the membrane (21).

* * * * *